United States Patent [19]

Ulevich

[11] Patent Number: 4,979,355

[45] Date of Patent: Dec. 25, 1990

[54] SHIELDING PIECE FOR A SOCKET WRENCH

[75] Inventor: Eugene K. Ulevich, Southgate, Mich.

[73] Assignee: Gamax International, Inc., Taylor, Mich.

[21] Appl. No.: 392,213

[22] Filed: Aug. 10, 1989

Related U.S. Application Data

[63] Continuation-in-part of Ser. No. 234,472, Aug. 22, 1988, abandoned, which is a continuation-in-part of Ser. No. 108,966, Oct. 19, 1987, abandoned.

[51] Int. Cl.[5] ..... B25B 13/58

[52] U.S. Cl. ..... 81/188; 81/121.1; 81/125; 81/DIG. 11

[58] Field of Search ..... 81/121.1, 125, 185, 81/DIG. 11

[56] References Cited

U.S. PATENT DOCUMENTS 3,069,946 12/1962 Zilliox ..... 81/185
3,433,108 3/1969 Ondeck ..... 81/185

OTHER PUBLICATIONS

*Modern Tire Dealer,* 6/83, vol. 64, No. 7, p. 56, Stempf lugnut cover tool.

*Primary Examiner*—Frederick R. Schmidt
*Assistant Examiner*—M. Rachuba
*Attorney, Agent, or Firm*—John R. Benefiel

[57] ABSTRACT

A shielding piece is adapted to be placed over the end of a socket wrench to protect the finish of decorative nuts from marring by the socket during wrenching operations, the shielding piece formed from a cushioning glass filled polyurethane material sufficiently soft to be non-marring to the nut and wheel surfaces. The shielding piece is configured with an inner liner portion and an outer shell portion joined together so that when in place the inside and outside of the open end of the socket is completely covered to protect the adjacent wheel and hub surfaces from marring by the socket as the nuts are wrenched tight. A composite preferred version of the shielding piece is also disclosed, in which an aluminum liner is molded to a polyurethane nose piece, the aluminum liner being highly resistant to compression failure while being sufficiently soft to be non-marring to the nut wrenching surfaces. A lug wrench adapter having an attached shielding piece is also disclosed.

7 Claims, 2 Drawing Sheets

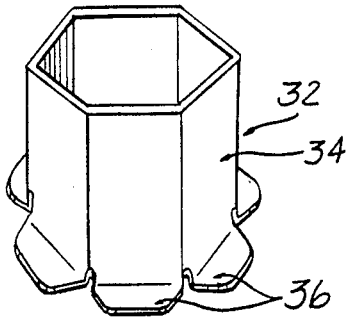
Fig-4
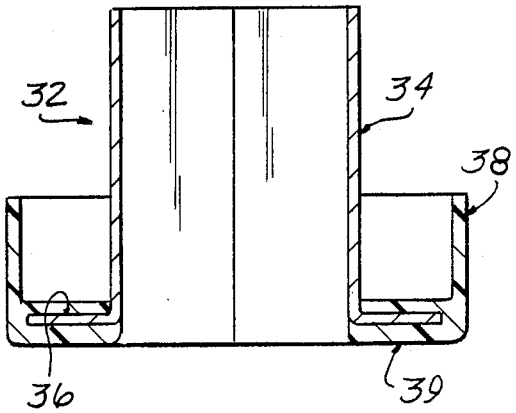
Fig-6
Fig-5
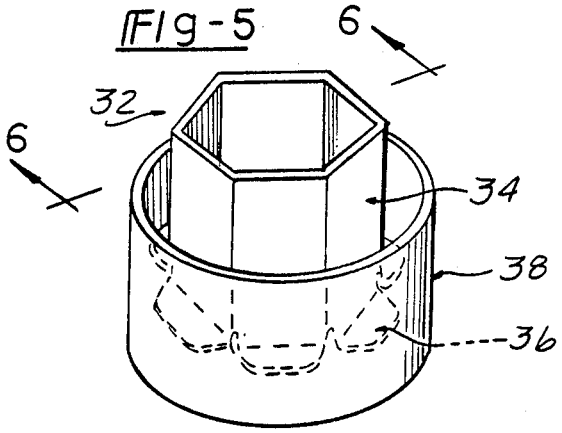
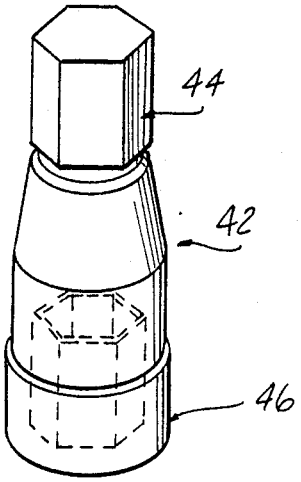
Fig-7
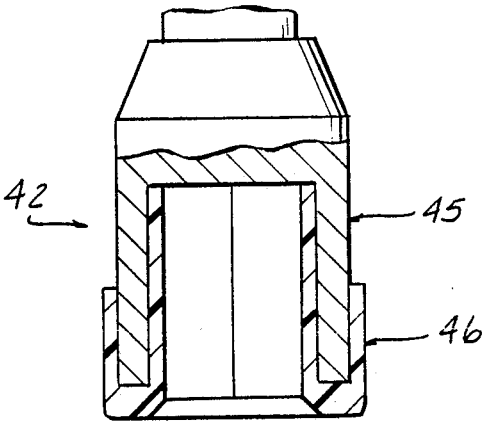
Fig-8

SHIELDING PIECE FOR A SOCKET WRENCH

CROSS-REFERENCE TO RELATED APPLICATION

This application is a continuation-in-part of Ser. No. 07/234,472 filed on Aug. 22, 1988, now abandoned, which is a continuation-in-part of Ser. No. 07/108,966, filed on Oct. 19, 1987, now abandoned.

BACKGROUND OF THE INVENTION

This invention concerns socket wrenches and more particularly, shield pieces for protecting decorative surface finishes from being marred during use of the socket wrenches.

In many instances, headed fasteners are provided with decorative surface finishes, such as the chrome plating of nut and bolt heads exposed to view to provide an aesthethic treatment. For example, auto wheel lug nuts are often exposed and chrome plated in sporty car models.

The pressure exerted in wrenching of such fasteners has a tendency to mar the finish, particularly in the instance of automotive wheel lug nuts, since the use of pneumatically driven tools increases the wrenching forces. Such pneumatic tools have come into widespread use in commercial tire and brake shops.

The end of the socket also mars the wheel surface as the nuts are wrenched tight, and the perimeter of the socket can mar closely adjacent finished wheel hubs by rubbing contact. Impacting of these surfaces also often inadvertently occurs, also resulting in damage to the decorative surfaces.

There has heretofore been provided cushioning inserts to reduce the incidence of marring of the nuts, as described in U.S. Pat. No. 3,433,108 issued to O. J. Ondeck on Mar. 18, 1969.

The insert described in the Ondeck patent comprises a short hollow cylinder mating with the inside of the socket wrench opening, the insert itself defining an inside opening mating with a hex fastener of a slightly smaller size than would otherwise be fit to the socket wrench. While such inserts do reduce the incidence of marring, the sockets can still mar the adjacent wheel and hub surfaces as the socket nut is wrenched on or off, and the pneumatic drives can destroy the insert after only a few uses.

The leading edge of the insert may be subjected to excessive pressure concentrations, tending to deform and loosen the insert, and the entire insert is easily dislodged unintentionally, particularly after extended use.

Since the insert of Ondeck only partially protects the surface, and has limitations when used with pneumatic tools, this design has not enjoyed widespread commercial success.

The Ondeck patent describes inserts made of Delrin and other plastics, which is satisfactory for manual wrenching, but which does not stand up in use with power tools.

The use of any plastic material as a wrench liner for short height nuts tends to result in splitting of the liner due to compressive stresses exerted by the wrenching process.

SUMMARY OF THE INVENTION

The present invention comprises a plastic shielding piece shaped to be interfit with the entire inside and outside surfaces of the open end of a socket wrench.

The shielding piece is comprised of a plastic piece having an outer shell portion of generally hollow cylindrical shape, configured to be pressed over the outside diameter of a socket wrench of a given size, combined with an inner liner portion having an outside shape configured to mate with the inside of the socket wrench and an inside shape configured to mate with a hex fastener of a given size.

The outer shell and inner liner portions are aligned at the outside end and joined by a connecting segment so that the entire open end of the socket wrench to which the shielding piece is fit is cushioned, inside and out, to shield not only the hex fastener but the surfaces surrounding the fastener.

The shielding piece in a first embodiment is constructed entirely of a glass filled polyurethane plastic which is tough and resilient enough so that the inner liner portion may withstand reasonable pressure from contact with the nut, while the outside shell is soft enough to be non-marring and not too brittle to be resistant to breaking if the socket is dropped.

The edges of the shielding piece are not subjected to pressure concentrations during wrenching and is thus more durable in use than the prior art inserts.

The shielding piece may be held by adhesive bonding to the socket wrench or may be friction fit to both the inside and outside of the socket wrench, but in either approach, the inside-outside interfit establishes a secure retention of the shielding piece on the wrench.

In another preferred embodiment of the shielding piece, a composite construction is employed able to withstand higher wrenching pressures without splitting.

In this embodiment, the inner liner portion is constructed of formed aluminum sheet metal molded to an outer shell portion of glass filled polyurethane plastic. The aluminum liner is sufficiently strong and ductile to withstand high wrenching pressure as when power wrenching short height nuts, but soft enough to avoid marring the wrenching surfaces of the nut. The outer shell of plastic prevents impact and rubbing marring of the nut or wheel surfaces.

The shielding piece is also combined with a lug wrench adapter comprised of a plug portion integral with a socket at the other end of a larger size able to receive a shielding piece and be fit to a standard lug nut.

DESCRIPTION OF THE DRAWINGS

FIG. 4 is a perspective view of the liner portion of a preferred composite embodiment of the shield piece according to the present invention.

FIG. 5 is a perspective view of the combined inner and outer portions of the composite embodiment of the shielding piece according to the invention.

FIG. 6 is a longitudinal sectional View of the composite shielding piece shown in FIG. 5.

FIG. 7 is a perspective view of a lug wrench adapter having a shielding piece secured thereto.

FIG. 8 is a longitudinal sectional view of the adapter shown in FIG. 7.

DETAILED DESCRIPTION

In the following detailed description, a specific embodiment will be described in accordance with the requirements of the law, and particular terminology is employed for the sake of clarity, but it is to be understood that the same is not intended to be limiting, and indeed should not be so construed inasmuch as the invention is capable of taking many forms and variations within the scope of the appended claims.

Figure 1:
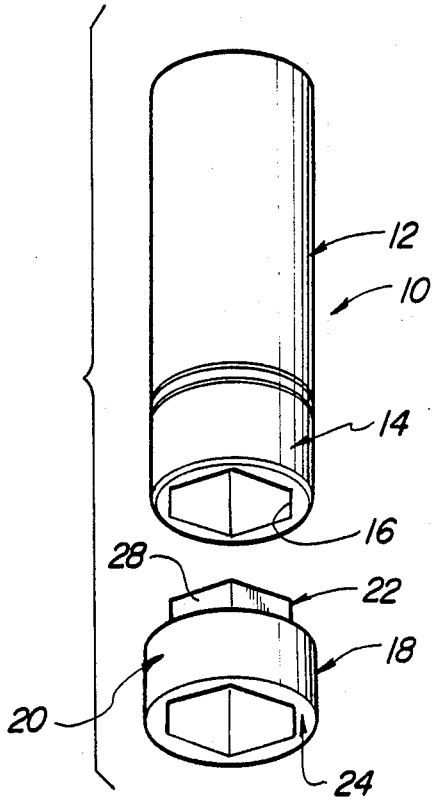
FIG. 1 is an exploded front perspective view of a shielding piece according to the present invention and a mating socket wrench.

Referring to the drawings, and particularly FIG. 1, a socket wrench 10 is shown of conventional construction comprised of a cylindrical body, one end 14 having an opening 16 shaped to mate with a hexagonal fastener, such as a bolt or nut (not shown). Typically, such shape is either hexagonal or double hexagonal (twelve point), the hexagonal shape illustrated.

The shielding piece 18 is a unitary plastic piece comprised of a continuous outer shell portion 20 and a continuous inner liner portion 22 each aligned and joined together at the outer end by a radially extending flange 24 comprising a connecting section.

Figure 2:
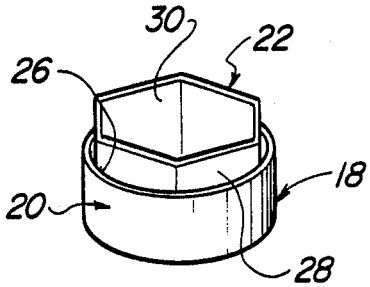
FIG. 2 is a rear perspective view of the shielding piece shown in FIG. 1.
Figure 3:
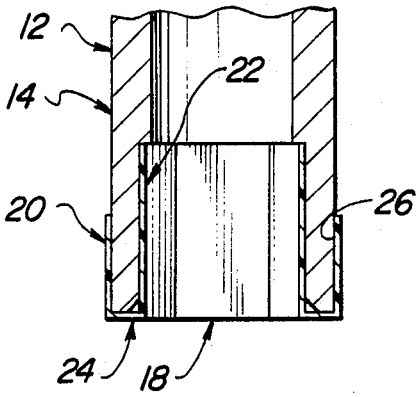
FIG. 3 is a fragmentary sectional view of the end portion of the socket wrench shown in FIG. 1 with the shielding piece in place.

The outer shell portion 20 is of a hollow cylindrical shape (FIG. 2), having an inside surface 26 configured to be press fit to the outside diameter of the open end 14 of the socket wrench body 12, completely covering the same.

The inner liner portion 22 has an outside surface 28 configured to be interfit to the inside surface of the opening 16 of the socket wrench 10, and an inside surface configured to mate with and completely enclosed a hex fastener of a given side. The wall thickness of the liner shell portion 22 is preferably on the order of 0.030 inches, so that standard sockets 10 may be employed, but reduced in size by 1/16 of an inch, i.e., a $\frac{3}{4}$ inch socket will fit an 11/16 inch bolt or nut. The outer shell portion may be thinner, on the order of 0.020 inches wall thickness.

The shielding piece 18 is preferably molded of plastic into a unitary piece able to absorb the pressure of wrenching without substantial deformation but soft enough to not mar the surface by the wrenching pressure.

The material of which the shielding piece 18 is constructed must be sufficiently tough as to withstand repeatedly the pressure exerted by the nut during wrenching without failing. At the same time the material must be sufficiently soft so that the outer shell 20 and flange 24 are non-marring when contacting the wheel or hub surfaces by impact or rubbing contact therewith.

Furthermore, the material should not be brittle so as to crack when the socket wrench 10 is dropped so as to strike the outer shell portion 20 or flange 24.

These difficult requirements have been found to be met by a polyurethane plastic, being reinforced with glass fibers. Such a material is commercially available, as from the RTP Co. (TM) of Winona MN, under the designation RTP 1200-80D Series, preferably having 20% glass fiber content.

While relatively a low strength material, it has been found that this material will deflect to relieve the stress when compressed, to withstand the nut pressure without failure over many cycles. At the same time, the material is 80–85 durometer, being soft enough to act as a cushion, and not mar the wheel or hub surfaces, in addition to protecting the nut surfaces.

The material also resists fracturing when the socket wrench 10 is dropped accidentally.

The shielding piece 18 may be press fit to the socket wrench 10, or permanently bonded with a suitable adhesive as desired.

The use of the shielding piece 18 according to the present invention results in a cushioning of the entire open end of the socket wrench 10, so that finished surfaces are entirely shielded, not only the wrenching flats of the hex fastener. The cushioned end of the socket wrench 10 provided by the flange 24 protects the wheel surface surrounding each nut, while the outer shell portion 20 protects an adjacent hub. This is important in high volume brake and tire shop using pneumatic tool drives and casual labor, where marring of expensive decoratively finished custom wheels and hub can create considerable customer dissatisfaction.

The "wrapped" construction eliminates the presence of an exposed edge at the opening of the shielding piece which otherwise be subject to pressure concentrations, creating a much more durable item than the prior art inserts.

Finally, the double fitting to inside and outside of the socket wrench 10 affords a more secure retention of the shielding piece 18 on the socket wrench 10.

A preferred, composite construction embodiment of the shielding piece 40 is shown in FIGS. 4–6, which is better able to withstand the greater wrenching pressures as are encountered with short height nuts.

In this embodiment, an inner liner portion 32 of formed soft metal, preferably aluminum is utilized, having a body 34 shaped and sized to be received in a standard hex socket wrench. A series of retention tabs 36 extend outwardly from one end of each flat of the hex shape.

The tabs 36 serve to connect this inner liner portion 32 in the molded outer shell portion 38 by being embedded in the connecting end portion 39, the outer and connecting portions 38, 39 extending to completely cover the end of a socket wrench. This outer shell portion is constructed of molded plastic of a polyurethane material as described above.

The relatively tough liner portions 32 serves to protect the nut surfaces during wrenching while very effectively resisting the wrenching pressures. At the same time, the nut and wheel surfaces are protected from impact marring by the softer plastic outer shell portion.

A lug adapter 42 is shown in FIGS. 7 and 8, in which a plug portion 44, configured to be received in a standard lug wrench, is integrally formed with a socket 45 of a greater size so that when fitted with a shielding piece 46, a standard lug nut may be engaged. The shielding piece 46 may be a unitary molded construction or of the ocmposite construction as described above.

I claim:

1. A socket wrench in combination with a shielding piece, said socket wrench being of a generally cylindrical shape having an open end with an inner shape adapted to mate with a hexagonal fastener, said shielding piece comprising a continuous unitary piece having:

an outer hollow cylindrical continuous shell portion of molded plastic having an interior surface shaped to fit over the outside of the end of a socket wrench and completely cover the outside of the end of said socket wrench;

a continuous hollow inner liner portion of soft metal lying within said outer shell portion with a space therebetween and having an outside surface shaped to mate with the inside of a socket wrench and an inside surface shaped to mate with and completely enclose a hexagonal fastener;

said outer and inner portions aligned at one end;

a connecting end portion of molded plastic joining said one end of each of said inner portion and said outer portion, said liner portion connected to said connecting end portion whereby said shielding piece is adapted to completely cover the inside and outside tip of the open end of said socket wrench.

2. The shielding piece according to claim 1 wherein said inner liner portion includes a series of tabs extending outwardly from each side of one end of said portion, said tabs embedded in said connector portion.

3. The shielding piece according to claim 1 wherein said inner liner portion is constructed of sheet aluminum and said outer and connecting portions are constructed of glass filled polyurethane plastic.

4. A shielding piece for cushioning the surfaces of a socket wrench to protect finishes from marring by the socket wrench, said shielding piece comprising a unitary piece having:

an outer hollow cylindrical continuous shell portion having an interior surface shaped to fit over the outside of the end of a socket wrench and completely cover the outside of the end of said socket wrench;

a continuous hollow inner liner portion lying within said outer shell portion with a space therebetween and having a continuous outside surface shaped to mate with the inside of a socket wrench completely covering the same; and a continuous inside surface shaped to mate with a hexagonal portion of a fastener to be wrenched and completely enclose the same;

an outer radially outward extending flange portion integral with said liner portion, covering the end face of a socket wrench into which said liner portion is inserted;

said outer and inner portions aligned at one end, and said flange portion joining said one end of each of said inner portion and said outer portion, whereby said shielding piece is adapted to completely cover the inside and outside tip of the open end of a socket wrench said outer portion and said connecting end portion constructed of molded plastic and said inner liner portion constructed of a soft metal secured to said connecting end portion.

5. The shielding piece according to claim 4 wherein said inner liner portion includes a series of tabs extending outwardly from each side of one end of said portion, said tabs embedded in said connector portion.

6. The shielding piece according to claim 4 wherein said inner liner portion is constructed of sheet aluminum and said outer and connecting portions are constructed of glass filled polyurethane plastic.

7. An adaptor for a lug wrench, comprising a plug portion shaped to be fit in a lug socket wrench; an integral socket portion extending from said plug portion having a wrenching socket of a slightly greater size than said plug portion;

a shielding insert installed in said wrenching socket reducing the size thereof to said plug size; said insert including:

an outer hollow cylindrical continuous shell portion of molded plastic having an interior surface shaped to fit over the outside of the end of said socket portion of said adapter and completely cover the outside of the socket portion of said adapter;

a continuous hollow inner liner portion of soft metal lying within said outer shell portion with a space therebetween and having an outside surface shaped to mate with the inside of the socket portion of said adapter and an inside surface shaped to mate with and completely enclose a hexagonal fastener;

said outer and inner portions aligned at one end;

a connecting end portion of molded plastic joining said one end of each of said inner portion and said outer portion, whereby said shielding piece is adapted to completely cover the inside and outside tip of the open end of said socket portion of said adaptor.

* * * * *